United States Patent [19]

Novey

[11] Patent Number: 5,029,547

[45] Date of Patent: Jul. 9, 1991

[54] REMOTE STEERING CONTROL FOR OUTBOARD POWERHEADS

[76] Inventor: Richard T. Novey, 1031 Linden Ave., Glendale, Calif. 91201

[21] Appl. No.: 512,473

[22] Filed: Apr. 23, 1990

Related U.S. Application Data

[63] Continuation-in-part of Ser. No. 260,506, Oct. 20, 1988, Pat. No. 4,946,411.

[51] Int. Cl.[5] ..... B63H 25/08

[52] U.S. Cl. ..... 114/159; 440/60; 440/900

[58] Field of Search ..... 440/53, 58, 60, 900, 440/6, 7; 114/159, 153, 144 E, 144 R; 74/89.18, 480 B

[56] References Cited

U.S. PATENT DOCUMENTS

| | | | |
|---|---|---|---|
| 86,043 | 1/1869 | Tomlinson | 114/159 |
| 2,700,358 | 1/1955 | Johnson | 440/60 |
| 2,735,393 | 2/1956 | White | 440/60 X |
| 2,804,838 | 9/1957 | Moser | 74/480 B |
| 3,161,072 | 12/1964 | Tourneau | 74/89.18 |
| 3,580,212 | 5/1971 | Fortson | 115/18 |
| 4,432,737 | 2/1984 | Johansson | 441/53 |
| 4,669,987 | 6/1987 | Schulte | 440/6 |
| 4,715,836 | 12/1987 | Schulte | 440/6 |

FOREIGN PATENT DOCUMENTS

| | | | |
|---|---|---|---|
| 20532 | of 1908 | United Kingdom | 114/159 |

*Primary Examiner*—Ed Swinehart

*Attorney, Agent, or Firm*—William H. Maxwell

[57] ABSTRACT

A remote steering control for outboard powerheads on boats, having a reversible motor and pinion mounted on a bracket moving with the powerhead engaging a tiller segment on the motor mount, steering right and left in response to a remote and portable hand held control.

15 Claims, 2 Drawing Sheets

FIG. 1.
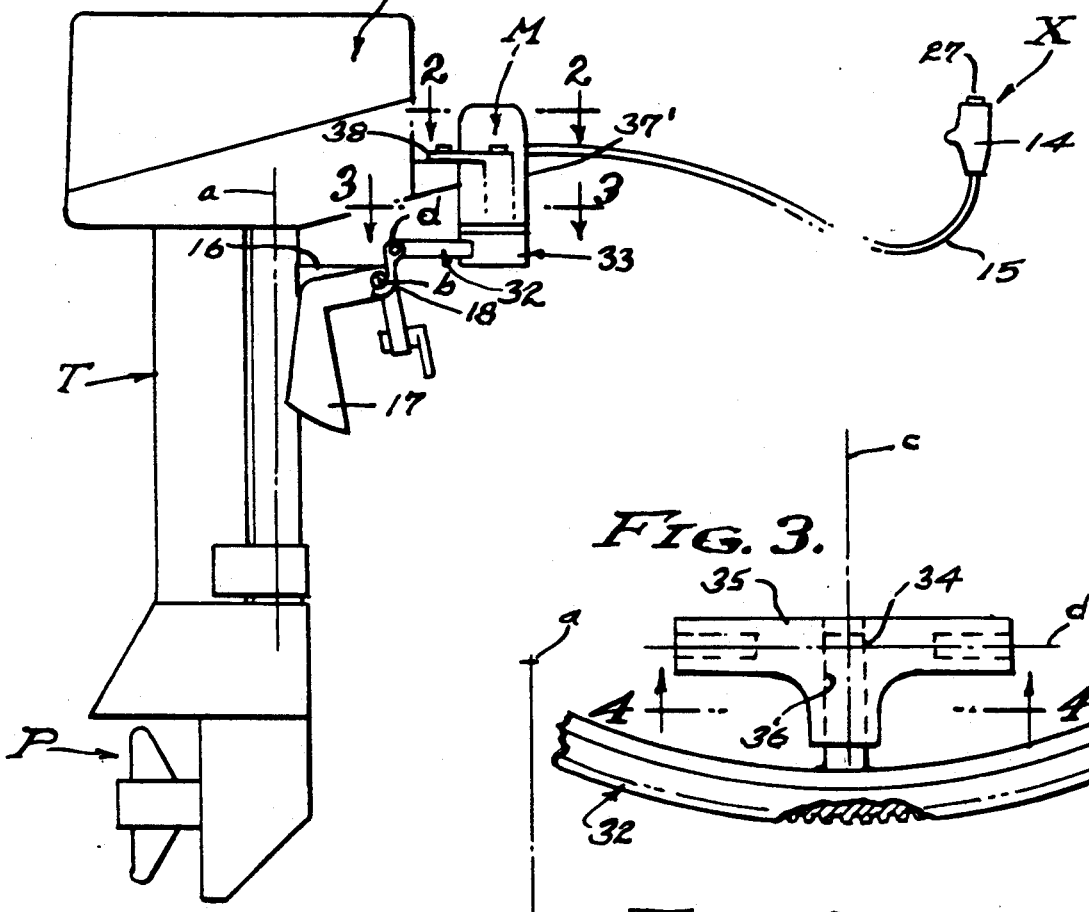
FIG. 3.
FIG. 4
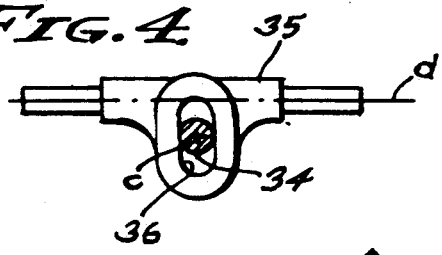
FIG. 2.
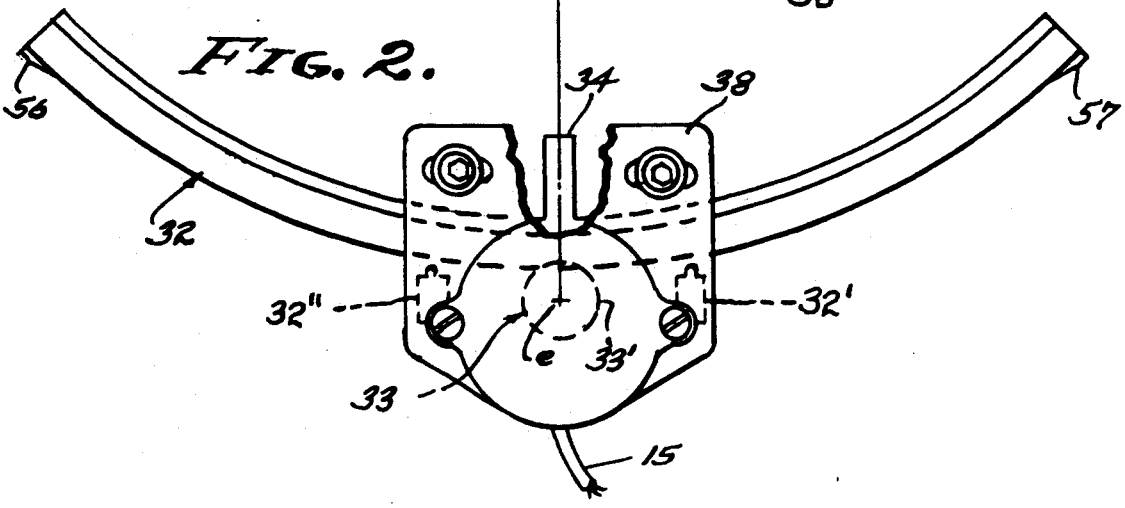

REMOTE STEERING CONTROL FOR OUTBOARD POWERHEADS

This application is copending with and a continuation in part of my application Ser. No. 07/260,506 filed Oct. 20, 1988, now U.S. Pat. No. 4,946,411, Aug. 7, 1990 for HAND HELD REMOTE CONTROL FOR OUTBOARD POWERHEADS.

BACKGROUND OF THE INVENTION

This invention relates to the control of outboard motors for small recreational vessels, whereby steering is remotely controlled. It is the powerhead of an outboard motor unit that is involved, such units being self contained for the most part. That is, the engine and its accessories and controls are incorporated in the powerhead from which a drive tube depends into the water where the propeller assembly operates, and all of which is pivotally carried by a bracket secured by a clamp frame to the transom of the vessel so as to swing upwardly on a transverse axis to avoid grounding, and so as to be trimmed for propulsion.

Steering is by means of vertical pivoting of the powerhead-drive tube-propeller assembly on the swinging bracket, with a forwardly projecting steering handle or with cables extending from an equivalent steering bracket to a pilot station having a steering wheel or the like.

Throttling is by means of a lever system that controls carburetion and spark advance or retard; assuming that most all outboard engines are internal combustion gasoline engines and the like.

Shifting is by means of a lever system that engages the propeller assembly for forward and reverse operation, the engine having one direction of rotation.

The basic function of steering is of primary concern, and there are the aforesaid engine functions, it being a general object of this invention to provide a hand held steering station that is extended by an electrical cable to any desired location aboard the vessel being operated thereby. The supporting functions involving fuel and electrical battery power are state of the art, and control therefor (not shown) is also included in the hand held remote control station.

Outboard motor powerheads are of compact design with the basic controls hereinabove referred to incorporated in the powerhead for control by lever operation. The typical powerhead is enhanced by a tight fitting housing, at the immediate exterior of which all of the functional controls are accessible for direct manual operation or by remote cable control, as above stated. It is an object of this invention to tie into these basic controls as they are accessible at the powerhead, and to provide electrical servo steering operation controlled remotely by a mobile hand held pilot station. Electrical power for operation of this system is provided by the existant battery power supply of the outboard motor.

It is an object of this invention to incorporate a steering servo at the powerhead of an outboard motor, for steering the vessel powered thereby from a remote hand held pilot station. Outboard motors of the type under consideration have a steering bracket for remote cable steering, and this steering bracket closely overlies the mounting frame that is clamped to the transom of the vessel. It is this steering bracket and mounting frame relationship that is advantageously employed herein to carry a gear segment or the like and a servo motor and pinion, the servo motor thereof being reversely controlled by the remote hand held pilot station to turn the powerhead left and right.

The steering of the vessel is a constant function that requires instant response and rapid operation with substantial torque. It is an object of this invention to provide these requirements by employing a small high speed continuous duty motor with high rate gear reduction to a pinion shaft that shifts the steering from right to left. In practice, the motor servo has a geared head with a high ratio gear train that is for all intents and purposes non-reversible. That is, the gear train effectively locks the steering position when the servo motor is deenergized, the small high speed motor being characterized by quick acceleration and quick deceleration as well.

The remote hand held pilot station is characterized by the three vessel controlling functions, namely steering, throttling and shifting, the steering function being shown as electrical, and the controlling servo motor of the steering operates individually so as to obtain straight away and right or left steering of any angle desired, within the limits of the powerhead.

SUMMARY OF THE INVENTION

A primary object of this invention is to provide a hand held pilot station for outboard powered vessels. This pilot station is mobile and is connected to the outboard powerhead through a multi conductor control cable. Operation is electrical and relies upon the battery power supply of the outboard unit, for the servo function of steering. Electrical connections are through flexible cables, the hand held pilot station being transportable to any desired location on the vessel. The servo is characterized by a small high speed motor and high ratio gear drive unit, that inherently locks in selected positions, and which is quickly responsive for rapid operation of the functions involved. The steering function is characterized by a gear segment that is captured to operate through a pinion drive means and arcuate guide means.

The foregoing and various other objects and features of this invention will be apparent and fully understood from the following detailed description of the typical preferred form and application thereof, throughout which description reference is made to the accompanying drawings.

THE DRAWINGS

FIG. 1 is a side elevation of a typical outboard motor, showing the steering function servo installed thereon.

FIG. 2 is an enlarged fragmentary plan sectional view taken as indicated by line 2—2 on FIG. 1.

FIG. 3 is also an enlarged fragmentary plan sectional view and taken as indicated by line 3—3 on FIG. 1.

FIG. 4 is a sectional view taken as indicated by line 4—4 on FIG. 3.

PREFERRED EMBODIMENT

Figure 5:
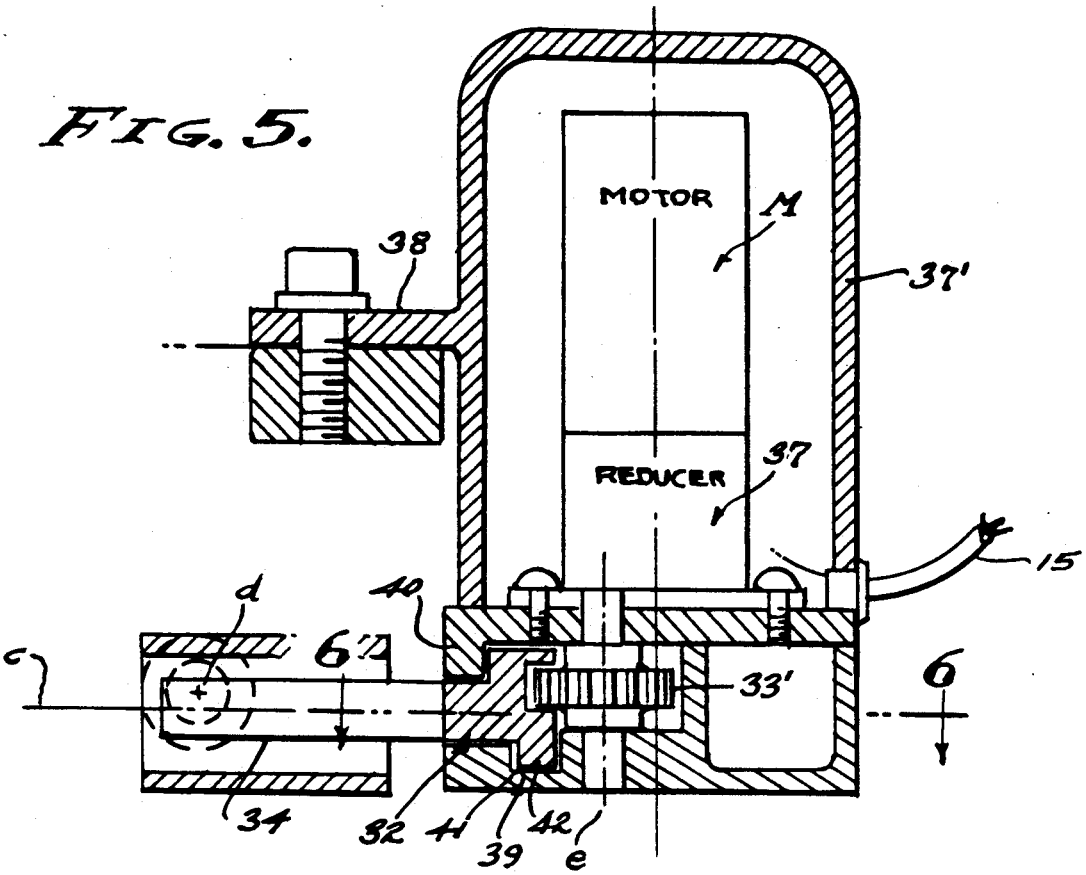
FIG. 5 is an enlarged detailed sectional view of the serovo unit installation.

Referring now to the drawings, FIG. 1 illustrates an outboard motor having a powerhead H, a drive tube T and a propeller assembly P. In accordance with this invention, the basic control function or steering is by left and right control means X. Said control means is characterized by an electric motor drive, and all of which is controlled by the hand held pilot station or means X. Additionally, but not shown, the pilot station includes ignition control means, start control means, kill or stop control means, and a tachometer. As shown, the pilot station means X is carried by a hand held grip 14 from which a flexible cable 15 extends to the powerhead H. The powerhead H and drive tube T with the propeller assembly P pivot together on a substantially vertical axis a by means of a bracket 16 that swings on a transverse horizontal axis b secured to the transom of the vessel (not shown) by a mounting clamp frame 17, all in a conventional manner.

The powerhead H is characterized by the primary control function of steering, by means of the powerhead-drive tube-propeller assembly pivoted on axis a, there being a steering bracket 18 as part of and tilting with the bracket 16 closely overlying the mounting or clamp frame 17, to which the steering means of the present invention is connected by a steering coupling 35.

The hand held pilot station and means X includes the grip 14 to expose control elements for manipulation. There is a left to right (port to starboard) rocker switch 27. And there are separate switches (not shown) for reverse, neutral and forward gear shifting.

Referring now to the steering control means of the present invention, the powerhead bracket 18 is coupled to a reversible motor M to positionably rotate the powerhead-drive tube-propeller assembly on the pivotal axis a. The steering control is comprised of a segmental member 32 rotated about axis a by a drive means 33 reversely rotated by the motor M. As shown, the segmental member 32 is an arcuate rack or the like, and the drive means 33 is a pinion gear 33' or the like. The rack member 32 is arcuate about the axis a and is coupled to the steering bracket 18 by a tiller pin 34 disposed on an axis c and engaged with a steering coupling 35 swivelly carried by the steering bracket 18 of the powerhead H on a transverse axis d sustantially intersecting axis c. The tiller axis c is disposed radially from the steering axis a, the tiller pin 34 being a short pin that slides into a vertically slotted opening 36 in the steering coupling 35, in order to accomodate deflections of the powerhead H when in operation. The coupling 35 axis d is disposed transversely and horizontally at a radius from the steering axis a, in order to permit the steering bracket 18 to accomodate working deflections of the powerhead H.

The motor drive to the pinion gear 33' is on an axis e, and through a high ratio gear box 37, as shown in FIG. 5. In practice, the gear box 37 and motor M is a speed reduction unit mounted in a protective case 37' secured by a mounting flange 38 to the front of the powerhead H, the motor M being a gear head motor. In practice, the gear reduction to the motor shaft and pinion gear 33' is 150 to 1, for discrete locked positioning of the powerhead. The case 37' is centrally mounted by the bracket 38 to have a depending shaft on axis e with the pinion gear 33' exposed rearwardly through a transversely open slot 37'' to pass the tiller pin 34 on its excursions.

In accordance with this invention, the segmental steering member 32 is flexible to the extent that it can be directed into uniform engagement with the pinion gear 33' by guide means 39 carried by the case 37'. In practice, the segmental steering member 32 is made of plastic material such Teflon or Nylon (trademarks) which are tough materials with substantial physical properties, so that the member 32 can be trained through the guide means 39 regardless of deflections of bracket 18 and coupling 35. As shown, the guide means 39 is comprised of top and bottom guide rails 40 and 41 to pass the member 32 as it is rotated about the steering axis a, and so as to maintain proper meshed engagement with the pinion gear 33'. The guide means is shown as comprised of the top and bottom rails curved concentrically with the axis a, the top rail being a front facing abutment engaging the top back corner of the arcuate steering member 32; and the bottom rail being a channel engaging front and back sides of a rib 42 at the bottom front corner of said member 32. The high ratio gear box 37 is self locking, so as to hold whatever steering position is set thereby. The gear head motor M is a small fractional horse power motor that is reversible and quick to accelerate, being located within the case 37' of the powerhead at the front face thereof.

Figure 6:
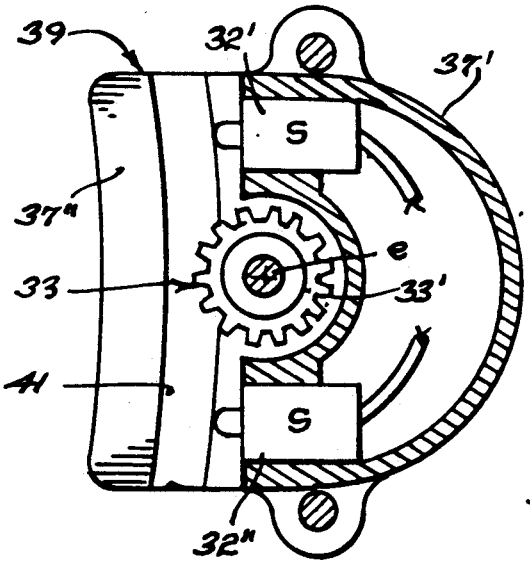
FIG. 6 is a plan sectional view taken substantially as indicated by line 6—6 on FIG. 5.
Figure 7:
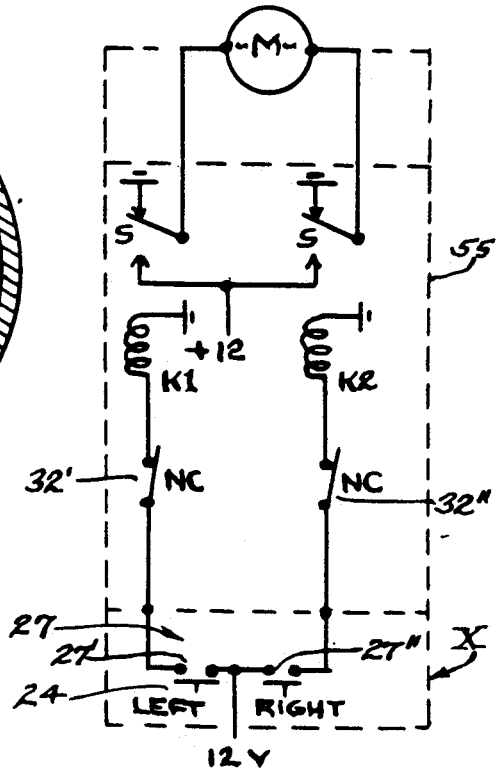
FIG. 7 is an electrical diagram of the system control.

Referring now to the electrical control circuit of FIG. 7 of the drawings, the electrical system is located in three areas, on the powerhead H, in a relay box 55, and in the hand held pilot station means X. There are relays K1 and K2 located in the relay box 55, shown in their de-energized conditions, single pole double throw relays used to control motor M. There are manually operable switches 27' and 27'' for left and right steering, located in the hand held pilot means X. And there are normally closed limit switches 32' and 32'' for de-energizing the motor M at the extreme, positions of steering member 32. As shown in FIGS. 5 and 6 of the drawings, the case 37' carries the two limit switches 32' and 32'', each with an actuator exposed to the front face of the steering element 32. And as shown in FIG. 2 the opposite end portions of steering element 32 are provided with cam members 56 and 57 for alternately actuating said switches.

Operation is as follows; Steering is by reversible operation of the servo motor M, by relays K1 and K2, as controlled by rocker switch 27 and protected by limit switches 32' and 32''. This operation is clear from diagram FIG. 7. In the event that the left steering switch 27' is held to the limit of steering movement, the limit switch 32' is opened by cam member 57. And conversely, when the right steering switch 27'' is held to the limit of steering movement, the limit switch 32'' is opened by the cam member 56. Accordingly, the steering system is protected from over-running the motor M, while continued return operation is assured.

Having described only the typical preferred form and application of my invention, I do not wish to be limited or restricted to the specific details herein set forth, but wish to reserve to myself any modifications or variations that may appear to those skilled in the art as set forth within the limits of the following claims.

I claim:

1. A steering control for outboard powerheads pivoted on a steering axis and including;

a reversible motor and pinion carried by the powerhead and engaged with a segmental member arcuately disposed about the steering axis and acting between the powerhead and a mounted bracket therefor to turn the powerhead reversely on said steering axis, a tiller pin spaced from the steering axis and carried by the segmental member on an axis disposed radially from the steering axis, a coupling member carried by the mounted bracket and engageably receiving the tiller pin, and a circuit means having right and left switches reversely operating the reversible motor and pinion engaged with said segmental member to steer the powerhead.

2. The steering control for outboard powerheads as set forth in claim 1, wherein the pinion is driven by the motor through a gear box carried by the powerhead and overlying the mounted bracket and the segmental member carried thereby and engaged by the pinion.

3. The steering control for outboard powerheads as set forth in claim 2, wherein the motor and the gear box form a gearhead unit carried by the powerhead to turn therewith.

4. The steering control for outboard powerheads as set forth in claim 1, wherein a guide means slidably embraces the segmental member holding geared engagement of the pinion therewith.

5. The steering control for outboard powerheads as set forth in claim 1, wherein the segmental member is made of flexible materal to conform with structural deflections, and wherein a guide means slidably embraces the segmental member to hold engagement of the pinion.

6. The steering control for outboard powerheads as set forth in claim 1, wherein the segmental member is an arcuate gear rack concentric with the steering axis and wherein the pinion is a gear in mesh therewith.

7. The steering control for outboard powerheads as set forth in claim 2, wherein the segmental member is an arcuate gear rack concentric with the steering axis and wherein the pinion is a gear in mesh therewith.

8. The steering control for outboard powerheads as set forth in claim 3, wherein the segmental member is an arcuate gear rack concentric with the steering axis and wherein the pinion is a gear in mesh therewith.

9. The steering control for outboard powerheads as set forth in claim 4, wherein the segmental member is an arcuate gear rack concentric with the steering axis and wherein the pinion is a gear in mesh therewith.

10. The steering control for outboard powerheads as set forth in claim 5, wherein the segmental member is an arcuate gear rack concentric with the steering axis and wherein the pinion is a gear in mesh therewith.

11. The steering control for outboard powerheads as set forth in claim 4, wherein the guide means is comprised of rails guiding the segmental member.

12. The steering control for outboard powerheads as set forth in claim 5, wherein the guide means is comprised of top and bottom rails guiding the segmental member.

13. The steering control for outboard powerheads as set forth in claim 4, wherein the segmental member is arcuately formed of uniform cross section, and wherein the guide means includes a rail engaged with and arcuately guiding said member.

14. The steering control for outboard powerheads as set forth in claim 5, wherein the segmental member is arcuately formed of uniform cross section, and wherein the guide means includes top and bottom rails engaged with top and bottom portions of said member and arcuately guiding the same.

15. The steering control for outboard powerheads as set forth in claim 1, wherein the coupling member is swivally carried on a horizontal transverse axis by the mounted bracket and having a vertical slot slidably engaging the tiller pin.

* * * * *